US010655368B2

(12) United States Patent
Frello et al.

(10) Patent No.: US 10,655,368 B2
(45) Date of Patent: May 19, 2020

(54) ELECTRICAL DOOR LATCH WITH MOTOR RESET

(71) Applicant: Magna Closures Inc., Newmarket (CA)

(72) Inventors: Antonio Frello, Leghorn (IT); Davide Dente, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 352 days.

(21) Appl. No.: 15/672,604

(22) Filed: Aug. 9, 2017

(65) Prior Publication Data

US 2018/0044949 A1 Feb. 15, 2018

Related U.S. Application Data

(60) Provisional application No. 62/372,468, filed on Aug. 9, 2016.

(51) Int. Cl.

| | |
|---|---|
| ***E05B 77/14*** | (2014.01) |
| ***E05B 81/14*** | (2014.01) |
| ***E05B 81/64*** | (2014.01) |
| ***E05B 81/76*** | (2014.01) |
| ***E05B 81/04*** | (2014.01) |
| *E05B 81/82* | (2014.01) |
| *E05B 81/06* | (2014.01) |

(52) U.S. Cl.

CPC ..... *E05B 77/14* (2013.01); *E05B 81/04* (2013.01); *E05B 81/14* (2013.01); *E05B 81/64* (2013.01); *E05B 81/76* (2013.01); *E05B 81/06* (2013.01); *E05B 81/82* (2013.01)

(58) Field of Classification Search

CPC ..... E05B 77/14; E05B 77/16; E05B 77/18; E05B 81/00; E05B 81/04; E05B 81/54; E05B 81/06; E05B 81/14; E05B 81/15; E05B 81/64; E05B 81/66; E05B 81/68; E05B 81/76–78; E05B 81/82

USPC ..... 292/201

See application file for complete search history.

(56) References Cited

U.S. PATENT DOCUMENTS

| | | | | |
|---|---|---|---|---|
| 5,918,917 | A * | 7/1999 | Elton | E05B 81/20 292/201 |
| 7,170,253 | B2 * | 1/2007 | Spurr | E05B 81/06 318/286 |
| 8,764,075 | B2 * | 7/2014 | Taurasi | E05B 81/14 292/201 |
| 9,765,554 | B2 * | 9/2017 | Cumbo | E05B 81/14 |
| 2008/0224482 | A1 * | 9/2008 | Cumbo | E05B 77/02 292/216 |

(Continued)

*Primary Examiner* — Nathan Cumar

(74) *Attorney, Agent, or Firm* — Dickinson Wright PLLC

(57) ABSTRACT

An e-latch assembly and method for operating for a closure panel of a vehicle, the closure panel operable between an open state and a closed state. The e-latch assembly is configured to control via an open command to operate an electric motor of the e-latch assembly in order to change a state of the electric motor during a latch release operation from a motor home position to a motor open position; and to control via a a reset command to change the state from the motor open position to the motor home position by controlling the reset command only when one or more sensors indicate a position of at least one of the closure panel or a ratchet or a pawl of the e-latch assembly reflecting the closure panel returning from the open state to the closed state.

14 Claims, 3 Drawing Sheets

(56) References Cited

U.S. PATENT DOCUMENTS

| | | | | |
|---|---|---|---|---|
| 2010/0117379 | A1* | 5/2010 | Mitchell | E05B 77/06 292/216 |
| 2015/0368934 | A1* | 12/2015 | Tomaszewski | B60Q 9/00 292/199 |
| 2017/0074008 | A1* | 3/2017 | Marlia | E05B 77/22 |

* cited by examiner

ELECTRICAL DOOR LATCH WITH MOTOR RESET

CROSS-REFERENCE TO RELATED APPLICATIONS

This application claims priority from U.S. provisional patent application No. 62/372,468, filed on Aug. 9, 2016; the entire contents of which are hereby incorporated by reference herein.

FIELD

The present application relates to the field of door latches, and, in particular, of door latches such as may be employed in automotive apparatus.

BACKGROUND

It is known that electrical latches are provided in motor vehicles, for example for controlling opening and closing of the side doors.

One of the defining characteristics of an electrical door latch (E-latch) is that it does not have a mechanical linkage to an outside or inside door handle. Instead, the door is released by an actuator, in response to an electrical signal coming from the handles. The E-latch generally includes a ratchet that is selectively rotatable with respect to a striker fixed to a door post, in order to latch and unlatch the door. The E-latch includes a pawl that selectively engages the ratchet to prevent the ratchet from rotating. The E-latch includes an electric motor, which is electrically connected to a main electric power supply of the vehicle (for example to the 12V battery of the same vehicle), in order to directly or indirectly drive the pawl, via an electrically-operated actuator.

With this there are many features that can be achieved with an E-latch that with a conventional mechanical door latches, require complex mechanical designs to realize. It is recognized that one disadvantage with E-latches is motor noise that is generated by one or more motors that are part of the E-latch. Operation of the motor(s) is required upon opening of the latch components as well in circumstances of reset.

SUMMARY

It is an object of the present disclosure to provide a system and method for an e-latch assembly to obviate or mitigate at least one of the above presented disadvantages.

A first aspect provided is an e-latch assembly for a closure panel of a vehicle, the closure panel operable between an open state and a closed state, the e-latch assembly comprising: a housing; an actuation group mounted in the housing including a ratchet, a pawl, and an electric motor for actuating at least one of the pawl or the ratchet; one or more sensors for detecting a position of at least one of the closure panel or the ratchet or the pawl; and a control unit having a control circuit configured to instruct via an open command operation of the electric motor in order to change a state of the electric motor during a latch release operation from a motor home position to a motor open position and instruct via a reset command to change the state from the motor open position to the motor home position, the control unit further configured for said instruct via the reset command only when the one or more sensors indicate the position reflecting the closure panel returning from the open state to the closed state.

A second aspect provided is a method for operating an e-latch assembly for a closure panel of a vehicle, the closure panel operable between an open state and a closed state, the method as performed by a computer processor executing a set of stored instructions comprising the steps of: instruct via an open command operation of an electric motor of the e-latch assembly in order to change a state of the electric motor during a latch release operation from a motor home position to a motor open position; and instruct via a reset command operation of the electric motor to change the state from the motor open position to the motor home position by performing said instruct via the reset command only when one or more sensors indicate a position of at least one of the closure panel or a ratchet or a pawl of the e-latch assembly reflecting the closure panel returning from the open state to the closed state.

BRIEF DESCRIPTION OF THE DRAWINGS

The foregoing and other aspects will now be described by way of example only with reference to the attached drawings, in which.

DESCRIPTION

Number 1 in FIGS. 1 and 2 indicates as a whole an electronic latch assembly (hereinafter e-latch assembly 1), coupled to a closure panel 2 (e.g. door) of a motor vehicle 3. However, it is again underlined that the e-latch assembly 1 can equally be coupled to any kind of closure device of the motor vehicle 3, such as but not limited to trunk lids or hatches.

Figure 1:
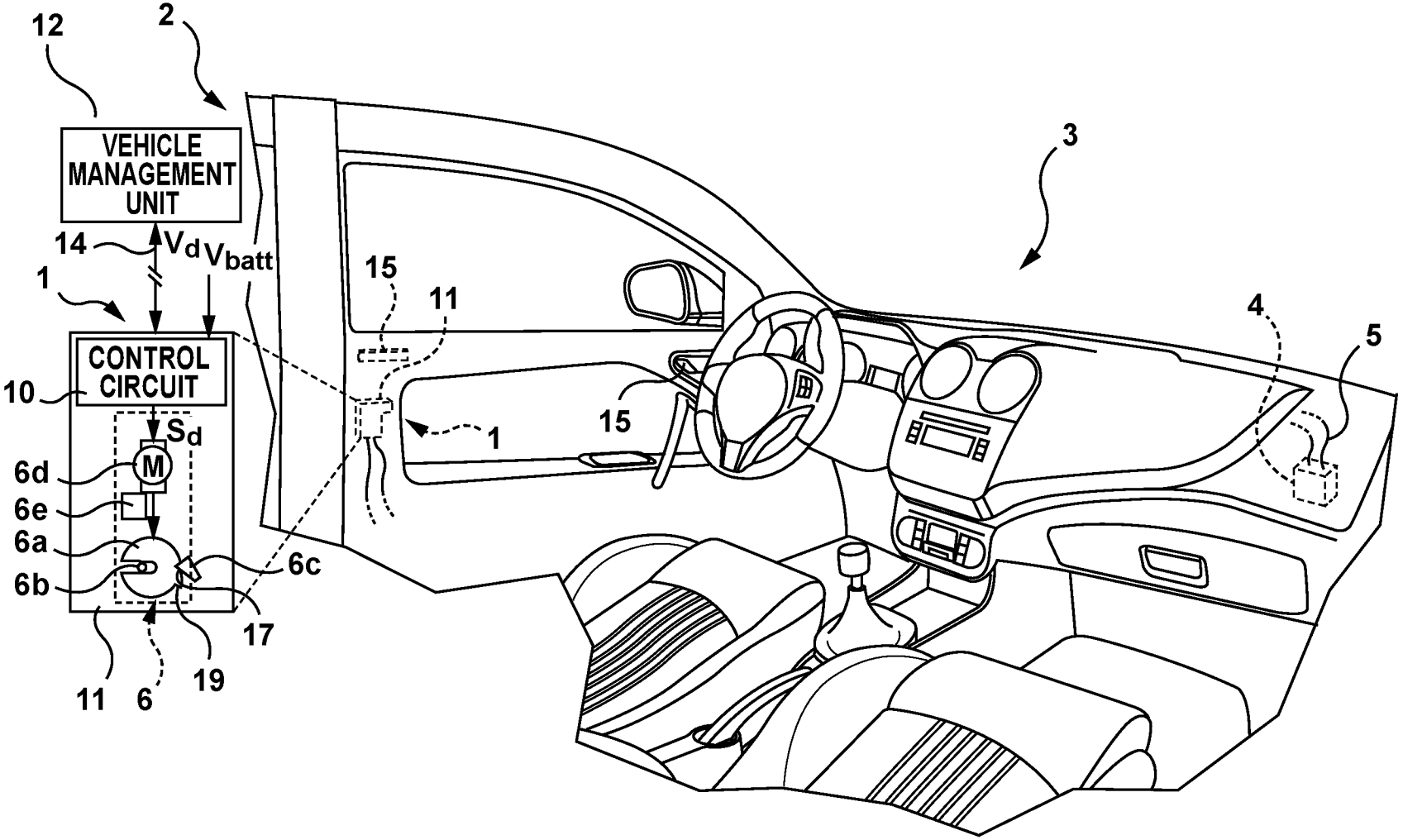
FIG. 1 is a perspective view of a vehicle incorporating an e-latch assembly.

Referring to FIG. 1, the e-latch assembly 1 is electrically connected to a main power source 4 of the motor vehicle 3, for example a main battery providing a battery voltage Vbatt of 12 V, through an electrical connection element 5, for example a power cable (the main power source 4 may equally include a different source of electrical energy within the motor vehicle 3, for example an alternator).

The e-latch assembly 1 includes an actuation group 6 including an electric motor **6*d*, operable to control actuation of the door 2 (or in general of the vehicle closure device). In a possible embodiment, the actuation group 6 includes a ratchet 6*a* rotatably mounted to a housing 11, which is selectively rotatable to engage a striker 6*b* (fixed to the body of the motor vehicle 3, for example to the so called "A pillar" or "B pillar", in a manner not shown in detail). Ratchet 6*a* rotates between unlatched, secondary latched/closed and primary latched/closed positions, and biased via a biasing element (e.g. spring) to the unlatched position. When the ratchet 6*a* is rotated into the latched position with respect to the striker 6*b*, the door 2 is in a closed state, as either latched and cinched (e.g. primary closed state) or latched and uncinched (i.e. secondary closed state). It is recognized that the cinch operation of the closure panel 2 is optional, such that the actuation group 6** may not have a cinching lever, as desired.

A pawl 6*c* selectively engages the ratchet 6*a* to prevent it from rotating, directly or indirectly driven by an electric motor 6*d* so as to move between engaged positions (one for the primary closed position and one for the secondary closed position) and a non-engaged position. In the embodiment as illustrated in FIG. 1, the pawl 6*c* selectively engages a first notch 17 when the ratchet 6*a* is in the secondary closed position, and engages a second notch 19 when the ratchet 6*a* is in the primary closed position, however other ratchet configurations may be provided. The pawl 6*c* is rotatably mounted to the housing 11 and positioned to engage and retain the ratchet 6*a* in the primary and/or secondary closed positions. The pawl 6*c* can be biased to continuously engage the ratchet 6*a* via a biasing element (e.g, spring). It is recognized that the motor 6*d* is responsible for being engaged by a release signal (an open command—e.g. via operation of the door handle 15, key fob, detected presence of operator, etc.) in order to rotate to position the pawl 6*c* and/or ratchet 6*a* (and any other components of the actuation group 6) into the open position/state. It is recognized that the motor 6*d* can be coupled to the ratchet 6*a* and or the pawl 6*c* by a motor shaft, for example, in order to effect rotation of the ratchet 6*a* and/or pawl 6*c* under direction by a control unit 21 (see FIG. 2) via a driving/command signal Sd, further described below. Once the closure panel 2 has been opened and then is in the process of returning (or returned) to the closed position/state, the motor 6*d* is then commanded (e.g. reset command Sd) by the control unit 21 to rotate back into the motor home position (i.e. motor reset), in order to be in position to open the e-latch assembly 1 by operation of the components of the actuation group 6. It is preferable to have the reset of the motor 6*d* to be performed upon closing of the closure panel 2, as sensed by one or more of the sensors 9,13 further described below.

The actuation group 6 can also optionally have a cinching lever 6*e* mounted within the housing 11 of the e-latch assembly 1. A spring (not shown) can apply a biasing force against one side of cinching lever 6*e* urging the cinching lever 6*e* towards the ratchet 6*a*, for example. Alternatively, the cinching lever 6*e* can be configured to act directly on the striker Sb, rather than indirectly on the striker 6*b* via the ratchet 6*a*. The cinching lever 6*e* is configured to receive a driving engagement from an actuator of the electric motor 6*d* to provide driving movement/rotation of the cinching lever 6*e* towards a cinched position and/or uncinched position. The cinching lever 6*e* can rotate the ratchet 6*a* until the pawl 6*c* engages into its primary closed position and thus holds or otherwise retains the ratchet 6*a* in the primary closed position. Once the cinch operation is complete, the cinch actuation mechanism as controlled by the electric motor 6*d* can "reset" or return the cinching lever 6*e* to a cinch home position (i.e. cinch reset) so as not to block the ratchet 6*a* from rotation into the release position once the pawl 6*c* is disengaged, in order to release the ratchet 6*a* from the primary closed position to the secondary closed position or to release the ratchet 6*a* from the secondary closed position to the unlatched or open position.

As such, the cinching lever 6*e* of the actuation group 6 can be actuated by the electric motor 6*d* to cinch the e-latch assembly 1 from the secondary closed position to the primary closed position, as well as to return the cinching lever 6*e* to its home position once the e-latch 1 has been cinched. It is recognized that the cinched position can be defined as engagement of the cinching lever 6*e* with the ratchet 6*a* and/or striker 6*b* to drive the striker 6*b* into the latched primary closed position of the e-latch assembly 1 (e.g. the door 2 is locked and cinched). It is recognized that the uncinched or home position can be defined as disengagement of the cinching lever 6*e* from the ratchet 6*a* and/or striker 6*b*. In the uncinched position or home position of the cinching lever 6*e*, the ratchet 6*a* is held engaged with the striker 6*b* in the primary closed position by the pawl 6*c*.

Referring again to FIG. 1, the e-latch assembly 1 further includes an electronic control circuit 10, for example including, as discussed in detail hereinafter, a microcontroller or other known computing unit with associate memory for storing instructions for execution by the computing unit (see FIG. 3), which, in a possible embodiment, is conveniently embedded and arranged in a same housing or case 11 (shown schematically) together with the actuation group 6 of the e-latch assembly 1, thus providing an integrated compact and easy-to-assemble unit. The electronic control circuit 10 is coupled to the actuation group 6 and provides to the electric motor 6*d* suitable driving signals Sd.

The electronic control circuit 10 is electrically coupled to a vehicle management unit 12, which is configured to control general operation of the motor vehicle 3, via an electrical connection element 14, for example a data bus, so as to exchange signals, data, commands and/or information Vd indicative of a state of the vehicle 3, including positioning of the individual components of the actuation group 6, state of the main power source 4, and/or circuit integrity of the main power source 4 connection to the electronic control circuit 10, and/or vehicle management system 12.

Figure 2:
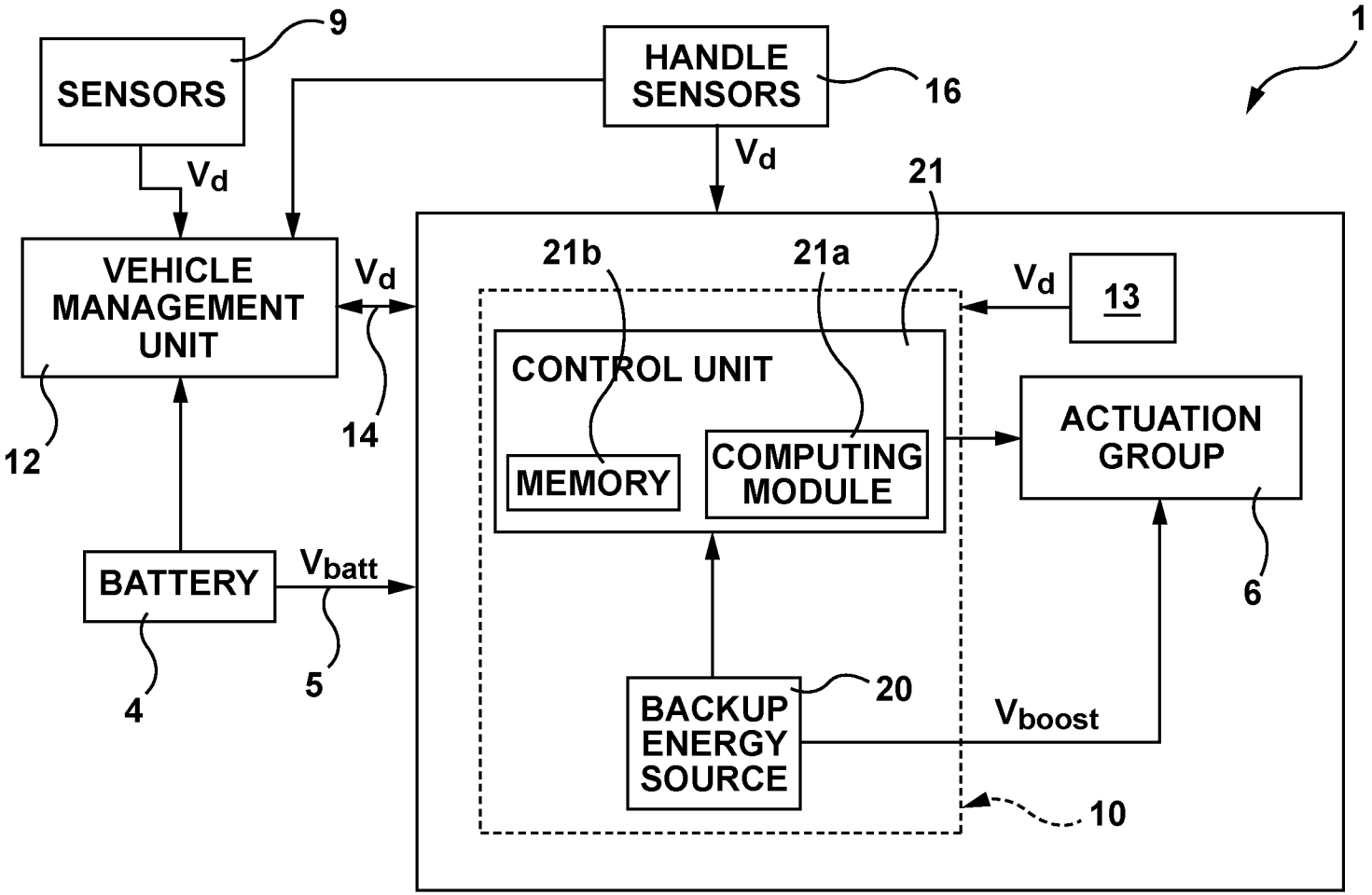
FIG. 2 is a modular block diagram of an embodiment of the e-latch assembly of FIG. 1.

Now referring to FIG. 2, in addition to FIG. 1, the vehicle management unit 12 is also coupled to sensors 9, for example voltage, current and/or power sensors, which can provide signals Vd, indicating (e.g. the state of the main power source 4 and electrical connections of same to the e-latch assembly 1, as well as current lock state of the e-latch assembly 1, etc.) to the vehicle management unit 12 and/or the control circuit 10. An integrated backup energy source 20 can also be a "passive" device accessed by the e-latch assembly 1, such that the backup energy source 20 is available to power the e-latch assembly 1 in the event that the main power source 4 is not available.

Further, the signals Vd can be interpreted by the vehicle management unit 12 and/or the control unit 21 (see FIG. 2), as part of the electronic control circuit 10, to represent one or more of a variety of state conditions experienced by the vehicle 3 and/or the e-latch assembly 1. For example, the state conditions can be fault condition(s) of the main power source 4 (including connection circuit failure between the main power source 4 and the e-latch assembly 1), operational position of components in the actuation group 6 (including position of the cinching lever 6*e* with respect to lock state of the e-latch assembly 1, position of the motor 6*d* with respect to lock state of the e-latch assembly 1), and/or emergency conditions of the vehicle 3 itself (e.g. a crash condition).

As such, it is recognized that operation of the motor 6*d* under influence of the control unit 21 can be in a motor home or reset mode, whereby positioning of the motor 6*d* is controlled to position the motor 6*d* in a reset or home position (e.g. coinciding with primary closed position of the e-latch assembly 1). Alternatively, operation of the motor 6*d* under influence of the control unit 21 can be in a motor operation mode, whereby positioning of the motor 6*d* is controlled to position any of the actuation components 6 from the closed position to the open position (e.g. an open state or a secondary positional state of the e-latch assembly 1).

As such, it is recognized that operation of the cinching lever 6*e* under influence of the control unit 21 can be in a cinch operation mode, whereby positioning of the cinching lever 6*e* is controlled to position the striker 6*b* in a cinched position (e.g. primary closed position of the e-latch assembly 1). Alternatively, operation of the cinching lever 6*e* under influence of the control unit 21 can be in a cinch homing operation mode, whereby positioning of the cinching lever 6*e* is controlled to position the cinching lever 6*e* from the cinched position to the uncinched position (e.g. home cinch or reset state of the e-latch assembly 1).

Conveniently, the electronic control circuit 10 receives feedback information about the e-latch assembly 1 actuation from the position sensors 13, such as Hall sensors, configured to detect the operating position of the actuation group 6 (e.g. locked state, unlocked state, opened state, closed state, cinched state (e.g. primary closed state), uncinched state (e.g. secondary closed state), etc.), for example of the ratchet 6*a* and/or pawl 6*c* and/or cinching lever 6*e* and/or striker 6*b*; and also receives (directly and/or indirectly via the vehicle management unit 12) information Vd about user actuation of the vehicle (external and/or internal) handles 15 from handle sensors 16, which detect user activation of the internal and/or external handles 15 of the doors 2 of the motor vehicle 3. It is also recognized that the sensor 9,13 information can be indicative of closure panel 2 switching indicating closure panel 2 ajar/open or closure panel 2 closed.

The electronic control circuit 10 can also be coupled to the main power source 4 of the motor vehicle 3, so as to receive the battery voltage Vbatt; the electronic control circuit 10 is able to check if the value of the battery voltage Vbatt decreases below a predetermined threshold value. The electronic control circuit 10 can include the embedded and integrated backup energy source 20, which is configured to supply electrical energy to the latch electric motor 6*d* and to the same electronic control circuit 10, in case of failure or interruption of the main power source 4 of the motor vehicle 3.

Figure 3:
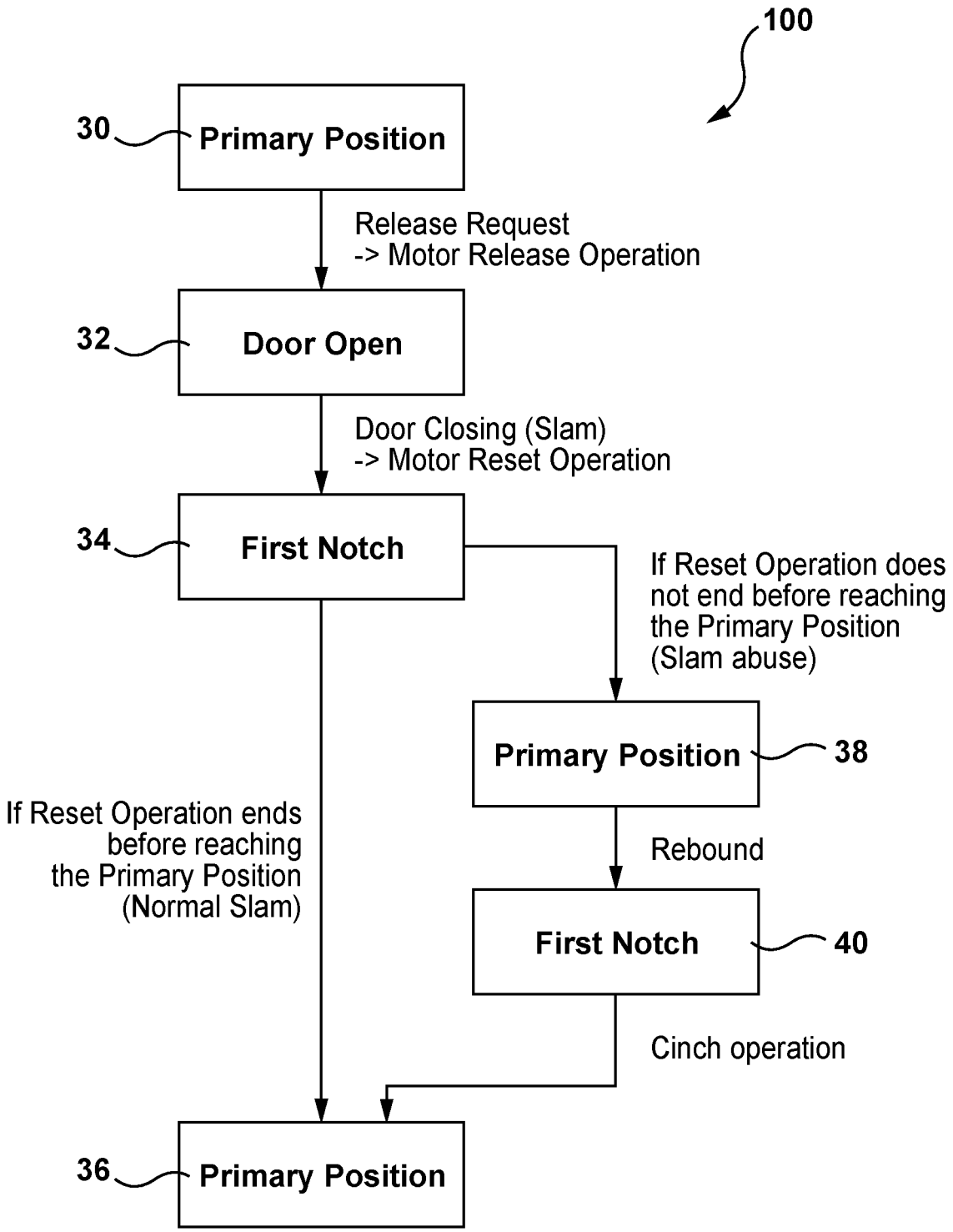
FIG. 3 is a flowchart of an example operation of the e-latch assembly of FIG. 2.

In more details, referring to FIG. 3, the electronic control circuit 10 includes the control unit 21, for example provided with a microcontroller, microprocessor or analogous computing module 21*a*, (providing the driving/command signal Sd to the actuation group 6 of the e-latch assembly 1 to control the operation of the actuation group 6 of the e-latch assembly 1. The control unit 21 has an embedded memory 21*b*, for example a non-volatile random access memory, coupled to the computing module 21*a*, storing suitable programs and computer instructions (for example in the form of a firmware). It is recognized that the control unit 21 could alternatively comprise a logical circuit of discrete components to carry out the functions of the computing module 21*a* and memory 21*b*, including acting upon the vehicle state signals Vd, handle sensor 16 signals Vd, position sensor 13 signals Vd, and/or detected or otherwise recognized fault condition(s) of the main power source 4 from the sensors 9, as further described below. The power to generate the driving signals Sd as well as operational power for the electric motor 6*d* can be provided by the main power source 4, and in the event of a fault condition of the main power source 4 then by the backup energy source 20.

The control unit 21 is configured to control the e-latch assembly 1 for controlling actuation of the door 2, based on signals Vd detected by the handle sensors 16, which are indicative for example of the user intention to open the door 2 of the motor vehicle 3, and optionally based on signals Vd received from the vehicle management unit 12, which are indicative for example of a correct authentication of the user carrying suitable authentication means (such as in a key fob) and/or as indication of the state of the vehicle 3 (one or more detected or otherwise recognized fault conditions of the main power source 4). It is also recognized that the handle sensors 16 can include signals Vd generated due to operation of buttons or other release controls by the vehicle occupant (e.g. hatch or trunk release lever or button located inside of the vehicle 3).

According to a particular aspect, the control unit 21 is also configured to manage pull signals Vd received from the handle sensors 16 and to implement, locally to the e-latch assembly 1, a suitable control algorithm (e.g. instructions stored in the memory 21*b* for execution by the computing module 21*a*) to control the same e-latch assembly 1 to facilitate release of the striker 6*b* from the ratchet 6*a* of the actuation group 6 of the e-latch assembly 1 under the appropriate release management procedure 100 (e.g. an example algorithm) as further described below. It is noted that release of the striker 6*b* can be dependent upon appropriate positioning of the cinching lever 6*e*, when present in the actuation group 6, (e.g. in the uncinched position) within the actuation group 6 and/or that release of the striker 6*b* can be dependent upon appropriate positioning of the motor 6*d* (e.g. in the home position).

In particular, the control unit 21 can, in view of receiving from the vehicle management unit 12 the vehicle state information signal Vd (e.g. indicative of one or more fault conditions of the main power system 4), position sensor 13 signals (e.g. indicative of latched state of the e-latch assembly 1), and/or door actuation signals Vd received from the handle sensors 16 (e.g. indicative of desire of vehicle 3 occupant to open the door 2), start, or otherwise complete the actuation group 6 release management procedure 100 (see FIG. 3), internally to the e-latch assembly 1, in order to provide for opening of the doors 2 of the motor vehicle 3. It is recognized that the release management procedure 100 provides for optional control of the cinching lever 6*e* (if present in the actuation group 6) via active positioning into the home or uncinched position (e.g. to account for the e-latch assembly 1 going from the primary to the secondary closed position or after the e-latch assembly 1 went from the secondary to the primary closed position). Further, it is recognized that the release management procedure 100 provides for control of the motor 6*d* via active positioning (i.e. rotating) into the open position (e.g. to account for the e-latch assembly 1 going from the primary to the secondary or open position) or active positioning (i.e. rotating) into the home or reset position (e.g. to account for the e-latch assembly 1 going from the secondary/open position to the primary closed position).

Referring to FIG. 3, the release management procedure 100 implemented by the control unit 21, locally to the e-latch assembly 1, provides at step 30 sensing that the closure panel 2 is in the primary closed position, i.e. via sensors 9,13. At step 32, a release/open signal (e.g. driving/command signals Sd) is generated by the control unit 21 (upon receipt of a door release signal—such as by handle sensors 16) in order to activate (e.g. rotate) the motor 6*d* (in response to the motor 6*d* receiving the signal(s) Sd) to cause operation of the pawl 6*c* and the ratchet 6*a* to allow the striker 6*b* to advance to the secondary open or open position. At this point, while the closure panel 2 remains open reflecting the open state of the e-latch assembly 1, the motor 6*d* also remains in the open state (i.e. is outside of the reset state). As such, when in the open state the motor 6*d* also remains in the open state (i.e. rotated as commanded by the driving/command signals Sd) to facilitate release of the striker 6*b* from the ratchet 6*a*. At step 34, upon sensing via sensors 9,13 that the closure panel 2 is in the process of closing (e.g. via vehicle state information signals Vd received by the control unit 21 such as Hall sensor information or other door switch information), the driving signals Sd are applied by the control unit 21 to the motor 6*d* (i.e. the motor 6*d* receives the signal(s) Sd) in order to rotate the motor 6*d* back into the motor reset or motor home position. It is advantageous to have the motor 6*d* reset by the control unit 21 only when the closure panel 2 is in the process of closing (e.g. positioned somewhere between the closure panel open position towards and/or reaching the closure panel closed position), so that reset noise of the motor 6*d* rotating (i.e. during operation of the motor 6*d*) is only generated in the process of the closure panel 2 closing (i.e, the closure panel 2 is between the open state and the closed state). For example, and as illustrated in FIG. 3, the control unit 21 may receive information from the position sensors 13 indicating that the closure panel 2 is travelling towards or otherwise resting in the closed (e.g. secondary) position (as indicated by a position sensor 13 sensing that the pawl 6*c* engages the first notch 17 (as shown in FIG. 1), or by other the sensor sensing the position of the ratchet 6*a* or otherwise). As such, generation of reset noise of the motor 6*d* can be masked or otherwise deemed acceptable to the vehicle operator when the closure panel 2 is travelling towards or otherwise resting in the closed (e.g. secondary) position. At step 36, the e-latch assembly 1 is back in the primary closed state, the sensors 9,13 indicate to the control unit 21 by vehicle state information signals Vd that the closure panel 2 is closed (also reflected by the e-latch assembly 1 being in the primary closed state), and the motor 6*d* is in the reset or home rotational position in order to facilitate a subsequent actuation of the actuation group 6 components to provide for reopening of the e-latch assembly 1 (i.e. to facilitate the striker 6*b* being released from the ratchet 6*a*).

In the event that the closure panel 2 is slammed by the operator upon closing, it can happen that reset operation of the motor 6*d* may not complete and thus the motor 6*d* is not in the motor home position before the pawl 6*c* and/or ratchet 6*a* reach the secondary closed position, otherwise known as slam abuse. In this case, at step 38 it is detected by the control unit 21 via vehicle state information signals Vd that the motor 6*d* has not completed the reset yet the ratchet 6*a* and pawl 6*c* are in the secondary closed position and the closure panel 2 is not yet in the closed position. This may be due to the closure panel 2 being slammed such that the ratchet 6*a* is rotated by the striker 6*b* to reach the primary closed position, yet due to the speed and force associated with the slam the pawl 6*c* fails to catch and engage the second notch 19. The pawl 6*c* may fail to catch and engage the second notch 19 due to the motor 6*d* not yet being in a reset position in order to rotate to position the pawl 6*c* and/or ratchet 6*a* (and any other components of the actuation group 6) out of the open position/state before the closure panel 2 has reached the primary closed position). As a consequence of the motor 6*d* not yet being in a reset position, the ratchet 6*a* may rebound from the primary closed position to the secondary closed position whereat the pawl 6*c* may engage the first notch 17 on its rebound. At step 40 the control unit 21 can send actuation signals Sd to the cinch lever 6*e* in order to return the actuation group 6 components to the primary closed position and thus cinch closed the closure panel 2 to arrive at step 36. It is recognized that once at step 36, the release management procedure 100 is ready to begin again at step 30.

Further to the above, it is recognized that at step 32 the control unit 21 can provide actuation signals Sd to open the cinch lever 6*e* (movement from cinched to uncinched). At step 40, the control unit 21 can provide actuation signals Sd to close the cinch lever 6*e* (movement from uncinched to cinched).

As such, the release management procedure 100 of FIG. 3 provides embodiments of operation of the motor 6*d* and optionally the cinching lever 6*e* by the control unit 21 of the actuation group 6. It is recognized that the control unit 21 can wait for the occurrence of signals Vd, for example by monitoring the signals Vd received from the handle sensors 16, position sensors 13 and/or power sensors 9. The handle activation signal Vd can be generated by the handle sensors 16 in any known manner, for example based on the activation of the handle 15 by the vehicle user. The position sensors 13 can be used to provide input signals Vd to the control unit 21 indicating that the ratchet 6*a*, pawl 6*c* and striker 6*b* are in the primary closed position and thus are in position to start the release operation mode of the motor 6*d* in order to place the e-latch assembly 1 in the secondary closed or open position. Further, the position sensors 13 can be used to provide input signals Vd to the control unit 21 indicating that the ratchet 6*a*, pawl 6*c* and striker 6*b* are in the open or secondary position and thus are in position to start the reset operation mode of the motor 6*d* (in order to place the motor 6*d* of e-latch assembly 1 in the reset or home position) only when the input signals Vd also indicate that the closure panel 2 is in the process of closing (e.g. returning from the open to the closed position).

It is also recognized that the management procedure 100 can include the control unit 21 configured to receive from the one or more sensors 13 the position reflecting at least one of the striker 6*b* or the ratchet 6*a* are in the secondary closed state, send the cinch command Sd to the electric motor 6*d* to operate the cinching lever 6*e* to position the ratchet 6*a* in the primary closed state, and check if the electric motor 6*d* is in the motor home position after the ratchet 6*a* is in the primary closed state. Further, the control circuit 21 can interrupt operation of the electric motor 6*d* when determining the state of the electric motor 6*d* is either in the motor open position or between the motor open position and the motor home position when at least one of the striker 6*b* or the ratchet 6*a* is in the secondary closed state, and thereafter generate the reset command Sd once the ratchet 6*a* is deemed (e.g via signals received from the position sensors 13) in the primary closed state.

Advantageously, the signals Vd can be received at an interrupt port of the control unit 21, so as to be promptly processed by the same control unit 21 via the computing module 21*a* in order to recognize a) the signal Vd as a closure panel 2 closing condition true or false, b) the signal Vd as a door open signal for example by handle 15 actuation by the vehicle 4 occupant, c) the e-latch assembly 1 is in the primary closed position, d) the motor 6*d* is in the open state or in the home/reset state, and/or e) the e-latch assembly 1 is in the secondary closed position or open position. It is also recognized that presence or absence of the signals Vd can be interpreted by computing module 21*a* as meaning that a change in state of the e-latch assembly 1 is desired by the vehicle occupant (e.g. from latched to unlatched or from unlatched to latched), for example the signal Vd is provided to the control unit 21 from the handle sensors 16 when actuated.

As discussed above, the control unit 21 having the control circuit 10 is configured to control operation of the motor 6*d* via the command signal(s) Sd. For example, this control aspect implemented by the control unit 21 can be embodied as instruct via the open command Sd operation of the electric motor 6*d* in order to change the state of the electric motor 6*d* during the latch release operation from the motor home position to the motor open position and as instruct via the reset command Sd to change the state from the motor open position to the motor home position. In particular, the control unit 21 can be configured for controlling by the described instruct via the reset command only when the one or more sensors 9 indicate that the position reflecting the closure panel 2 is returning from the open state to the closed state.

Further, for example, this control aspect implemented by the control unit 21 can be embodied as instruct via the open command Sd operation of an electric motor 6*d* of the e-latch assembly 1 in order to change the state of the electric motor 6*d* during the latch release operation from the motor home position to the motor open position, and as instruct via the reset command Sd operation of the electric motor 6*d* to change the state from the motor open position to the motor home position by performing the instruct via the reset command only when one or more sensors 9 indicate the position of at least one of the closure panel 2 or the ratchet 6*a* or the pawl 6*c* of the e-latch assembly 1 reflects the closure panel 2 returning from the open state to the closed state.

Embodiments according to the present description may not entail any modification of the vehicle management unit 12 or any vehicle parts outside the e-latch assembly 1; only a software modification may be required in the vehicle management unit 12 for suitable generation of the signals Vd, designed to start the release management procedure 100. In particular, it is again underlined that the e-latch assembly 1 may operate any kind of closure devices within the motorvehicle 3, different from the doors 2 thereof.

Clearly, changes may be made to what is described and illustrated herein without, however, departing from the scope defined in the accompanying claims.

We claim:

1. An e-latch assembly for a closure panel of a vehicle, the closure panel operable between an open state and a closed state, the e-latch assembly comprising:

a housing;

an actuation group mounted in the housing including a ratchet, a pawl, and an electric motor for actuating at least one of the pawl or the ratchet;

one or more sensors for detecting a position of at least one of the closure panel or the ratchet or the pawl; and a control unit having a control circuit configured to instruct via an open command operation of the electric motor in order to change a state of the electric motor during a latch release operation from a motor home position to a motor open position and instruct via a reset command to change the state from the motor open position to the motor home position, the control unit further configured for said instruct via the reset command only when the one or more sensors indicate the position reflecting the closure panel returning from the open state to the closed state, wherein a reset noise of the electric motor is only generated in a process of the closure panel closing.

2. The e-latch assembly of claim 1, wherein the closed state of the closure panel is selected from the group consisting of a secondary closed state and a primary closed state.

3. The e-latch assembly of claim 1 further comprising a cinching lever mounted in the housing for positioning the ratchet from the secondary closed state to the primary closed state, the cinching lever operated by the electric motor.

4. The e-latch assembly of claim 1, wherein the open command is an open driving signal generated by the control unit and received by the electric motor.

5. The e-latch assembly of claim 1, wherein the reset command is a reset driving signal generated by the control unit and received by the electric motor.

6. The e-latch assembly of claim 3 wherein the control unit is configured to receive from the one or more sensors the position reflecting at least one of a striker or the ratchet in the secondary closed state, send a cinch command to the electric motor to operate the cinching lever to position the ratchet in the primary closed state, and checking if the electric motor being in the motor home position after the ratchet being in the primary closed state.

7. The e-latch assembly of claim 3, wherein the control circuit interrupts operation of the electric motor when determining the state of the electric motor is either in the motor open position or between the motor open position and the motor home position when at least one of the striker or the ratchet is in the secondary closed state, and generating the reset command once the ratchet is in the primary closed state.

8. A method for operating an e-latch assembly for a closure panel of a vehicle, the closure panel operable between an open state and a closed state, the method as performed by a computer processor executing a set of stored instructions comprising the steps of:

instruct via an open command operation of an electric motor of the e-latch assembly in order to change a state of the electric motor during a latch release operation from a motor home position to a motor open position; and instruct via a reset command operation of the electric motor to change the state from the motor open position to the motor home position by performing said instruct via the reset command only when one or more sensors indicate a position of at least one of the closure panel or a ratchet or a pawl of the e-latch assembly reflecting the closure panel returning from the open state to the closed state, wherein a reset noise of the electric motor is only generated in a process of the closure panel closing.

9. The method of claim 8, wherein the closed state of the closure panel is selected from the group consisting of a secondary closed state and a primary closed state.

10. The method of claim 8, wherein the e-latch assembly includes a cinching lever for positioning the ratchet from the secondary closed state to the primary closed state, the cinching lever operated by the electric motor.

11. The method of claim 8, wherein the open command is an open driving signal generated by the computer processor and received by the electric motor.

12. The method of claim 8, wherein the reset command is a reset driving signal generated by the computer processor and received by the electric motor.

13. The method of claim 10 further comprising:

receiving from the one or more sensors the position reflecting at least one of a striker or the ratchet in the secondary closed state;

sending a cinch command to the electric motor to operate the cinching lever to position the ratchet in the primary closed state; and checking if the electric motor being in the motor home position after the ratchet being in the primary closed state.

14. The method of claim 13 further comprising:

interrupting operation of the electric motor when determining the state of the electric motor being either in the motor open position or between the motor open position and the motor home position when at least one of the striker or the ratchet being in the secondary dosed state; and generating the reset command once the ratchet being in the primary closed state.

* * * * *